US007713026B1

(12) United States Patent
Liang

(10) Patent No.: US 7,713,026 B1
(45) Date of Patent: May 11, 2010

(54) TURBINE BLADED WITH TIP COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 735 days.

(21) Appl. No.: 11/715,048

(22) Filed: Mar. 6, 2007

(51) Int. Cl.
*F01D 5/18* (2006.01)

(52) U.S. Cl. ..... 416/1; 416/97 R; 415/115; 415/1

(58) Field of Classification Search ..... 415/1, 415/115, 116; 416/1, 97 R, 96 A, 96 R
See application file for complete search history.

(56) References Cited

U.S. PATENT DOCUMENTS 4,411,597 A 10/1983 Koffel et al.
4,606,701 A * 8/1986 McClay et al. ..... 416/92
5,660,523 A 8/1997 Lee
5,738,491 A * 4/1998 Lee et al. ..... 415/177
5,997,251 A * 12/1999 Lee ..... 416/97 R
6,027,306 A * 2/2000 Bunker ..... 415/115
6,164,914 A 12/2000 Correia et al.
6,916,150 B2 7/2005 Liang
6,932,571 B2 8/2005 Cunha et al.
6,971,851 B2 12/2005 Liang
7,334,991 B2 * 2/2008 Liang ..... 416/97 R

* cited by examiner

*Primary Examiner*—Igor Kershteyn
(74) *Attorney, Agent, or Firm*—John Ryznic

(57) ABSTRACT

A turbine blade with a blade tip cooling passage formed within the blade tip and extending from the leading edge to the trailing edge. The blade tip passage includes a plurality of fins extending from the pressure side to the suction side walls of the passage, and in which each fin includes a cooling air opening, the openings of which alternate from the pressure side to the suction side in the passage to force the cooling air to flow in a sinusoidal manner. The openings also alternate from the bottom of the passage to the top of the passage so that the cooling air flows in a spiral shape manner. Film cooling holes are positioned along the pressure side walls for some of the spaces formed between adjacent fins to provide film cooling for the blade. A leading edge cooling supply channel supplies cooling air to the blade tip passage through a metering and impingement hole in the first space of the passage located on the leading edge. The fins with the alternating pattern of openings produce both impingement cooling and vortex cooling for the blade tip.

15 Claims, 5 Drawing Sheets

TURBINE BLADED WITH TIP COOLING

BACKGROUND OF THE INVENTION

1. Field of the Invention

The present invention relates generally to fluid reaction surfaces, and more specifically to turbine blade with a cooling circuit in the blade tip.

2. Description of the Related Art Including Information Disclosed Under 37 CFR 1.97 and 1.98

In the prior art, blade tip cooling is accomplished by drilling holes into the upper extremes of the serpentine flow coolant passages from both the pressure and suction side surfaces near the blade tip edge and the top surface of the squealer cavity. The cooling flow distribution and pressure ratio across these film cooling holes for the airfoil pressure and suction sides as well as the tip region is subject to severe secondary flow field, which translates into a large quantity of film cooling holes and cooling flow that is required for cooling the blade tip peripheral. FIG. 1 shows a prior art turbine blade tip cooling hole arrangement on the pressure side and FIG. 2 shows the same prior art turbine blade tip cooling hole arrangement for the suction side of the blade tip.

It is an object of the present invention to provide for a blade tip cooling circuit that will provide adequate blade tip cooling with less cooling air flow.

It is another object of the present invention to provide for a turbine blade with a blade tip cooling circuit that provides both impingement cooling and vortex flow cooling for the blade tip circuit.

BRIEF SUMMARY OF THE INVENTION

The present invention is a turbine blade with a blade tip cooling circuit formed between a tip ceiling and tip floor and the pressure side and suction side walls of the blade that forms a blade tip passage extending from the leading edge to the trailing edge of the tip. A cooling air supply hole is located in the tip floor to supply cooling air to the passage. A plurality of fins extend across from pressure side to suction side in the passage and have an opening in the corners that alternate from the pressure side to the suction side and allow the passage of the cooling air. The openings in the fins also alternate from the tip floor to the tip ceiling for the passage of the cooling air. Film cooling holes on the blade pressure side wall between each of the fins discharge cooling air from the blade tip passage to the airfoil surface. This alternating arrangement of fins provides for an impingement plus vortex cooling flow in the blade tip.

DETAILED DESCRIPTION OF THE INVENTION

Figure 1:
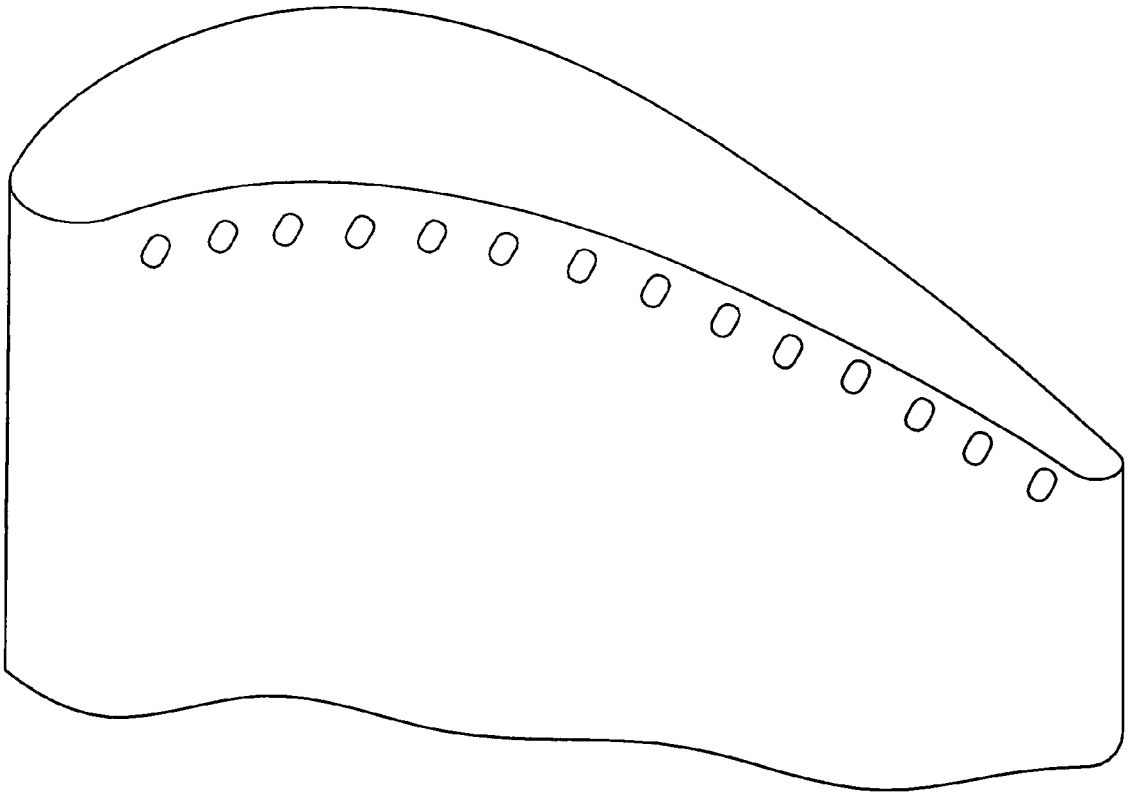
Fig 1 Prior Art
FIG. 1 shows a prior art turbine blade with film cooling holes on the pressure side tip region of the blade.
Figure 2:
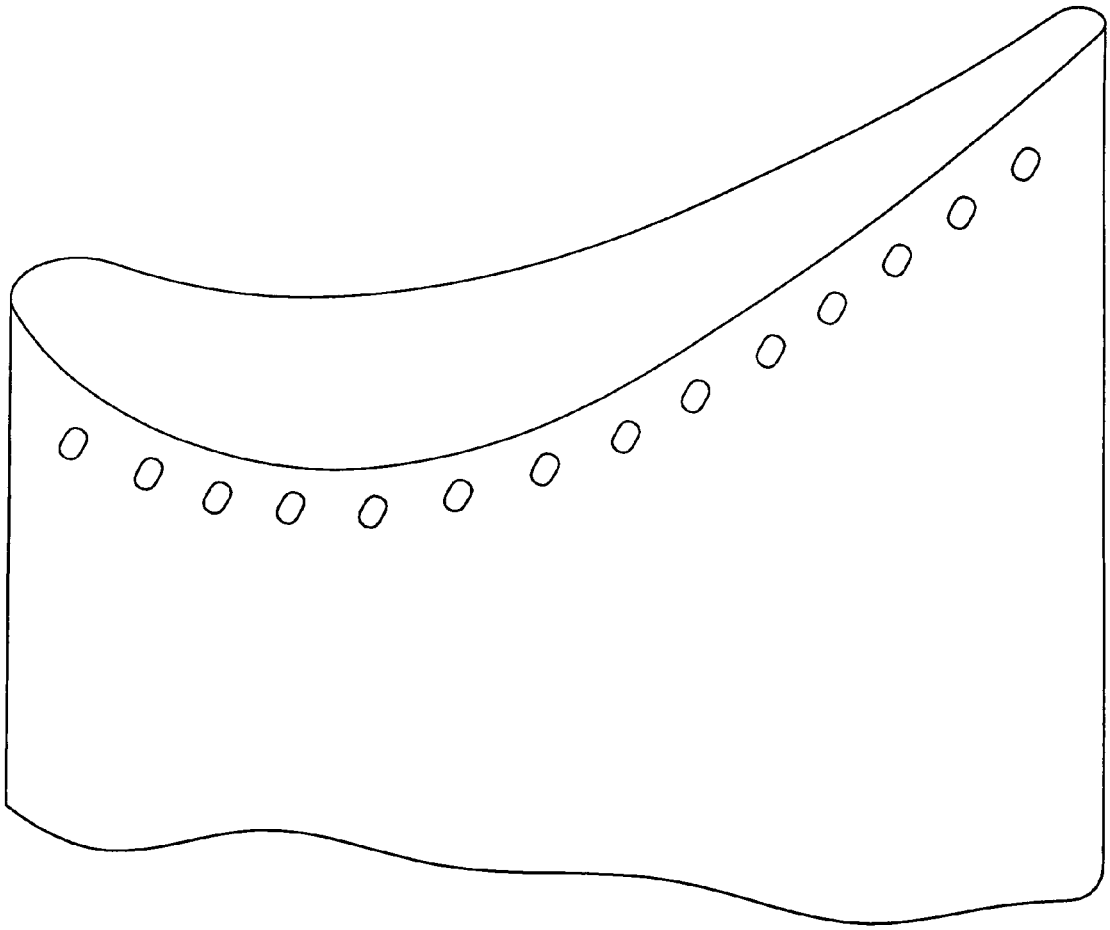
Fig 2 Prior Art
FIG. 2 shows a prior art turbine blade with film cooling holes on the suction side tip region of the blade.
Figure 3:
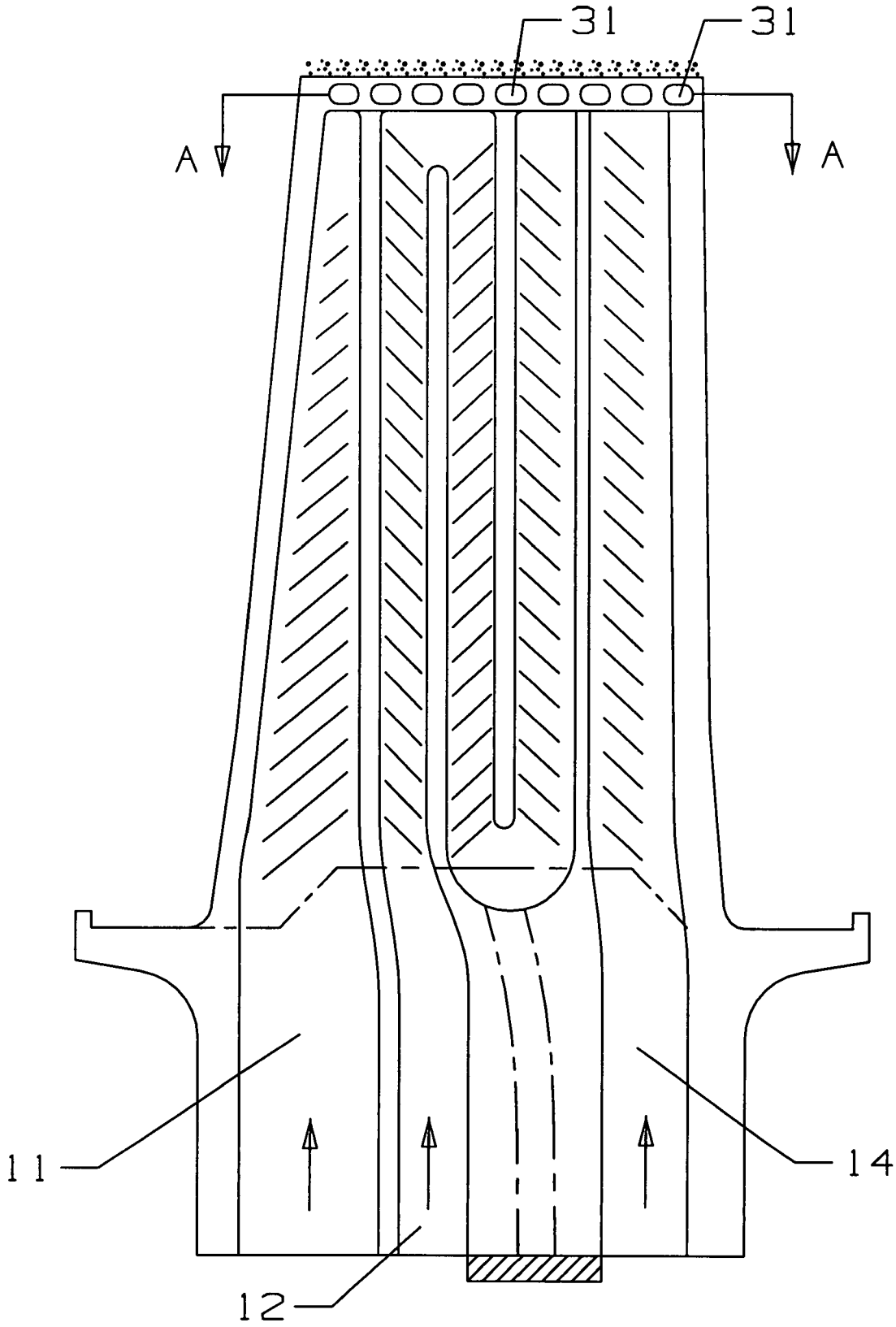
FIG. 3 shows a front cross section view of the turbine blade cooling circuit of the present invention.

The turbine blade with the blade tip cooling circuit of the present invention is shown in FIGS. 3 through 6. in FIG. 3, the main internal blade cooling circuit is shown and includes a leading edge single pass cooling channel 11, a middle three pass serpentine flow circuit 12 with a cover plate enclosing the cavity formed in the blade root at the turn of the second and third legs of this three pass circuit, and a trailing edge single pass cooling channel 14 extending along the trailing edge portion of the blade. Each of these channels includes trip strips to promote turbulence within the cooling air flow through the passage or channel.

Figure 4:
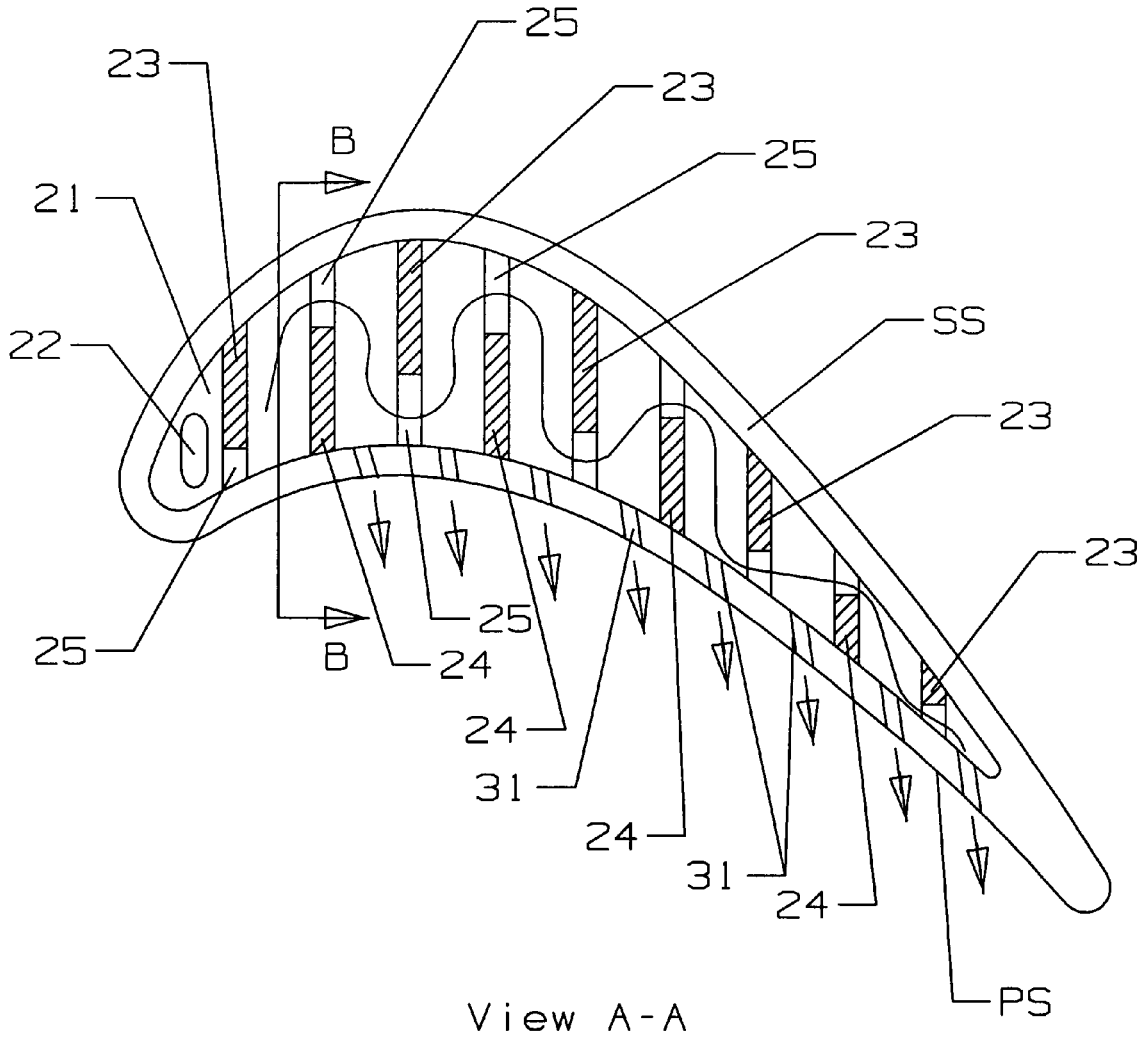
FIG. 4 shows a top cross section view of the blade tip cooling circuit of the present invention.
Figure 5:
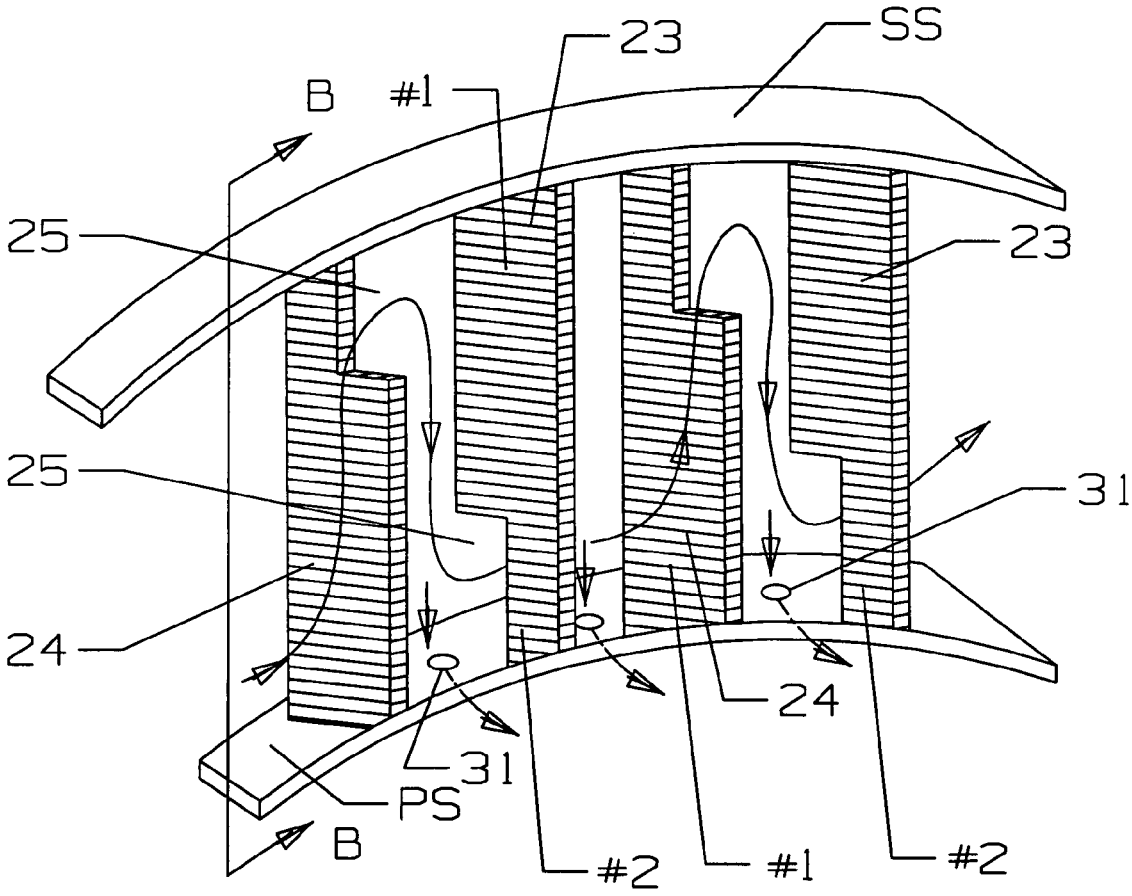
FIG. 5 shows a schematic view of a section of the blade tip cooling passage with the alternating fins of the present invention.
Figure 6:
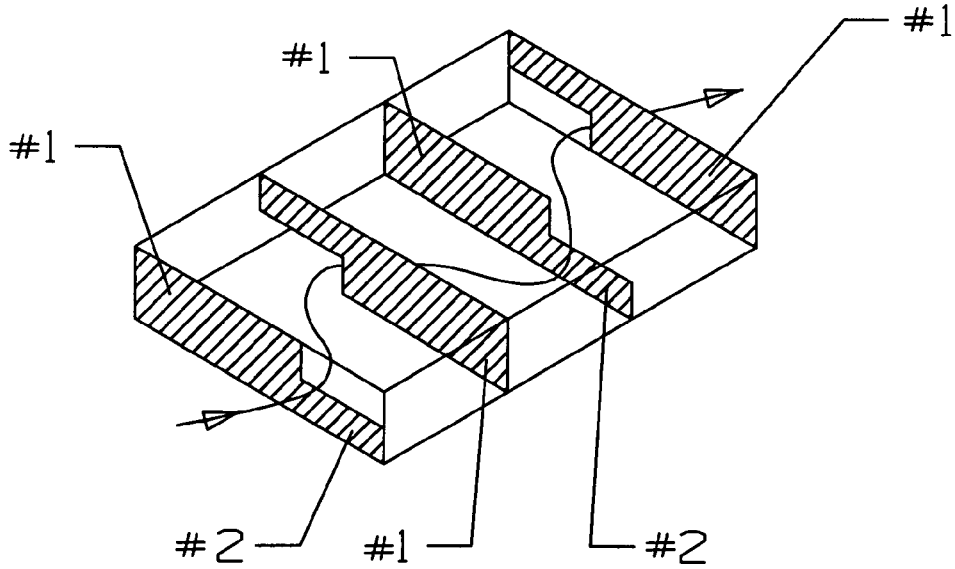
FIG. 6 shows another schematic view of a section of the blade tip cooling passage with the alternating fins of the present invention.

The main feature of the present invention is the cooling circuit located within the tip cap of the blade and shown best in FIGS. 4 through 6. In FIG. 4, a top view of the tip cap cooling circuit is shown. The tip cap includes a tip cap floor 21 that forms the top surface for the blade internal cooling channels or passages shown in FIG. 3. A cooling air supply hole 22 is located in the tip cap floor at the position shown in FIG. 4 that connects to the leading edge cooling supply channel 11 in the leading edge portion of the blade. The cooling air supply hole 22 also acts as a metering and impingement hole to meter the cooling air flow and to provide impingement cooling to the blade tip ceiling immediately above the supply hole 22. Extending along the tip cap passage as seen in FIG. 4 is a plurality of fins 23 and 24 that extend from the pressure side wall to the suction side wall of the tip cap passage. The fins 23 and 24 also extend from the tip cap floor 21 to the tip cap ceiling which forms the top of the overall blade. If a squealer cavity is formed on the tip of the blade, the tip cap ceiling would form the bottom of the squealer cavity. Each of the fins includes an opening 25 in one of the four corners of the fin to allow for the passage of cooling air through the tip cap channel. As seen in FIG. 4, the fins 23 have the opening 25 on the pressure side of the blade while the fins 24 have the opening on the suction side of the blade. The fins alternate within the tip cap channel such that the openings also alternate and produce a sinusoidal flow path through the tip cap channel.

The openings in the fins also alternate from the tip floor to the tip ceiling as seen in FIGS. 5 and 6 in which the pressure side wall and the suction side wall are shown, and the fins 23 and 24 extend from the walls with the openings 25 alternating from the tip cap floor (back of FIG. 5) to the front or tip cap ceiling (front of FIG. 5). The film cooling holes 31 are shown in FIG. 5 in the pressure side wall with one hole positioned between each fin 23 or 24. the film cooling holes 31 are also shown in FIGS. 3 and 4 where in FIG. 4 all of the spaces between adjacent fins 23 and 24 have a film cooling hole except for the space with the cooling air supply hole 22 and the space adjacent to and downstream from the front space. However, these two spaces could also have a film cooling hole to discharge cooling air from the space onto the pressure side wall of the airfoil. FIG. 6 shows another schematic view of the fins and the openings positioned within the tip cap channel that forms the spiral shaped cooling air flow pattern also shown in FIG. 5.

In FIGS. 4 through 6, the fins have cooling air openings 25 on the pressure or the suction side walls of the fins that extend all the way to the respective wall. in other embodiments of the present invention, the openings could extend close to the wall without the opening touching the wall. Each opening in the alternating series forming the cooling air passage must be offset form the adjacent openings in order to force the cooling air to flow in this pattern. Having fins without alternating openings would not provide as much of a serpentine flow as would the alternating fins and the heat transfer coefficient would decrease.

Operation of the cooling flow circuit of the present invention is now described. Pressurized cooling air enters the blade root in each of the three cavities located in the blade root as seen in FIG. 3 and flows up and into the blade through the leading edge channel 11, the middle three-pass serpentine flow channel 12, and the trailing edge channel 14. The cooling air flowing through the middle three-pass serpentine flow circuit will eventually flow out from the blade through film cooling holes arranged along the pressure or suction side walls of the airfoil. The cooling air flow through the trailing edge channel 14 will flow through a row of exit cooling holes arranged along the trailing edge of the blade. The cooling air flow through the leading edge channel 11 will flow through leading edge film cooling holes in the blade (not shown in the figure) with the remainder flowing through the cooling air supply hole 22 in the tip cap floor and into the tip cap cooling passage.

The cooling air that passes through the supply hole 22 will then flow through the opening 25 in the first fin 23, and then spiral around the tip cap passage through the alternating arrangement of openings in a spiral-like flow. In each of the spaces between adjacent fins, if a film cooling hole 31 is present some of the cooling air flow will pass through the film cooling hole 31 to provide film cooling for the pressure side tip edge of the blade. As the spirally cooling air flows through the tip cap passage, film cooling air is diverted out from the blade until the cooling air enters the last space in the tip cap passage and exits the blade through the last film cooling hole 31.

In the present invention, the blade tip could include a squealer tip formed above the tip cap cooling circuit with the alternating fins 23 and 24 and openings 25. The tip cap cooling flow circuit can also be compartmentalized for tailoring the gas side pressure distribution. The convective cooling air is then channeled from the blade mid-chord serpentine flow circuit 12 or the trailing edge flow circuit 14 and into the blade tip section through an additional cooling air supply hole to form impingement plus serpentine channels to form the spiral shaped cooling air flow through the circuits.

The advantages of the blade tip cooling circuit of the present invention are as follows. Reparability of the blade tip treatment—any blade tip treatment layer can be stripped and re-applied without the possibility of hole plugging or the difficulty of re-opening tip cooling holes. Elimination of blade tip drilling holes—since the entire cooling scheme can be cast into the airfoil, drilling cooling holes on top of the blade squealer floor can be eliminated, which will reduce the blade manufacturing cost and improve the blade life cycle cost. Elimination of blade core print out hole—the horizontal cooling channel and the metering hole can be used as the blade core print out hole. Elimination of the welding of the core print out holes is this accomplished. Also, this integral blade tip cooling scheme will prevent core shift by interconnecting the horizontal channels. Enhancing coolant flow—compartment of the horizontal cooling channel can also be incorporated into the current cooling concept which allows each individual cooling channel to be tailored for tip cooling flow to the various supply and discharge pressures around the airfoil tip. Higher overall blade tip cooling effectiveness—since coolant air is used first to cool the blade top surface by means of impingement plus vortex channel convection cooling and then discharges into the airfoil surface as film cooling. A higher heat transfer coefficient is generated by the vortex flow mechanism in the horizontal flow channel, yielding a cooler blade tip. This double usage of cooling air improves the overall cooling efficiency.

I claim the following:

1. A turbine blade for use in a gas turbine engine, the turbine blade comprising:

a cooling air supply channel extending from the blade root to the blade tip to supply cooling air to the blade tip;

a blade tip cooling air passage formed between a pressure side wall and a suction side wall of the blade;

a plurality of fins extending between the pressure and the suction side walls of the blade tip cooling air passage;

at least some of the fins having a cooling air opening located on the pressure side half of the fin; and, at least some of the fins having a cooling air opening on the suction side half of the fin.

2. The turbine blade of claim 1, and further comprising:

at least some of the fins have the opening on the floor side of the fin; and, at least some of the fins have the opening on the ceiling side of the fin.

3. The turbine blade of claim 1, and further comprising:

at least some of the spaces formed between adjacent fins include a film cooling hole to discharge cooling air from the blade tip cooling air passage and onto the external surface of the blade.

4. The turbine blade of claim 2, and further comprising:

the series of openings form substantially a spiral shaped flow passage through the blade tip cooling air passage.

5. The turbine blade of claim 1, and further comprising:

the cooling air supply channel is a leading edge channel; and, a metering and impingement hole located in the tip floor provides for the cooling air connection between the supply channel and the blade tip cooling air passage.

6. The turbine blade of claim 1, and further comprising:

the blade tip cooling air passage is a closed cooling air passage extending substantially from the leading edge to the trailing edge of the blade tip except for the cooling supply hole and the film cooling holes.

7. The turbine blade of claim 1, and further comprising:

the ceiling of the blade tip cooling passage forms a floor for a squealer tip cavity.

8. The turbine blade of claim 6, and further comprising:

the fins extend from the leading edge to the trailing edge of the blade tip; and, the cooling air openings alternate from pressure side to suction side of the passage, and from floor to ceiling of the passage to produce a spiral shape cooling air path.

9. The turbine blade of claim 8, and further comprising:

most of the spaces formed between adjacent fins include a film cooling hole to discharge cooling air to the external surface of the blade.

10. The turbine blade of claim 8, and further comprising:

the cooling air openings are of various sizes in order to regulate the cooling air pressures and flows through the passage and the film cooling holes.

11. The turbine blade of claim 1, and further comprising:

the fins and the cooling air openings produce both an impingement cooling and a vortex cooling for the blade tip.

12. A process for cooling a blade tip of a turbine blade, the turbine blade having a cooling air supply channel extending from the blade root to the blade tip, the process comprising the steps of:

metering at least some of the cooling air from the cooling supply channel into the blade tip;

passing the cooling air in the blade tip in an alternating manner from pressure side to suction side of the blade tip; and, discharging cooling air through film cooling holes along the blade tip as the cooling air passes toward the trailing edge of the blade.

13. The process for cooling a blade tip of a turbine blade of claim 12 above, and further comprising the step of:

the step of passing the cooling air in the blade tip in an alternating manner from pressure side to suction side of the blade tip also includes passing the cooling air in an alternating manner from the tip floor to the tip ceiling such that a spiral shape flow path is formed within the blade tip.

14. The process for cooling a blade tip of a turbine blade of claim 12 above, and further comprising the step of:

the step of metering at least some of the cooling air from the cooling supply channel into the blade tip includes impinging the cooling air into the blade tip to provide impingement cooling for the squealer tip.

15. The process for cooling a blade tip of a turbine blade of claim 14 above, and further comprising the step of:

the steps of metering and impinging the cooling air into the blade tip include passing the cooling air along a leading edge channel to provide cooling to the leading edge portion of the blade before metering the cooling air into the blade tip.

* * * * *